United States Patent [19]

Bartle, Sr.

[11] Patent Number: 4,615,361

[45] Date of Patent: Oct. 7, 1986

[54] EVACUATING PUMP

[76] Inventor: David C. Bartle, Sr., 421 S. Walnut St., Muncie, Ind. 47306

[21] Appl. No.: 690,698

[22] Filed: Jan. 11, 1985

[51] Int. Cl.[4] ..... B65B 31/04

[52] U.S. Cl. ..... 141/65; 417/550

[58] Field of Search ..... 141/8, 65; 417/550

[56] References Cited

U.S. PATENT DOCUMENTS

| | | | |
|---|---|---|---|
| 2,695,741 | 11/1954 | Haley | 141/65 |
| 3,175,590 | 3/1965 | Belknap | 141/8 |
| 3,312,256 | 4/1967 | Reisinger | 141/65 X |
| 3,672,114 | 6/1972 | Sacks | 141/65 X |
| 4,249,583 | 2/1981 | Lundbladh | 141/65 |

FOREIGN PATENT DOCUMENTS

| | | | |
|---|---|---|---|
| 3020534 | 3/1981 | Fed. Rep. of Germany | 417/550 |

*Primary Examiner*—Stephen Marcus
*Assistant Examiner*—Mark Thronson
*Attorney, Agent, or Firm*—James C. Wray

[57] ABSTRACT

An evacuating pump has a hollow cylindrical body, a cap at one end of the body, and a nozzle at the opposite end. A plunger disposed within the body has a piston attached to an inner end of a reciprocating rod, while the outer end of the rod extends through a bore provided in the cap. When the plunger is withdrawn, a vacuum is created at the nozzle, while on the inward stroke, a check valve flap seats over the nozzle inlet to prevent air from being injected through the nozzle. Air being compressed on the inward stroke escapes around the peripheral edge of the piston.

15 Claims, 4 Drawing Figures

FIG. 1
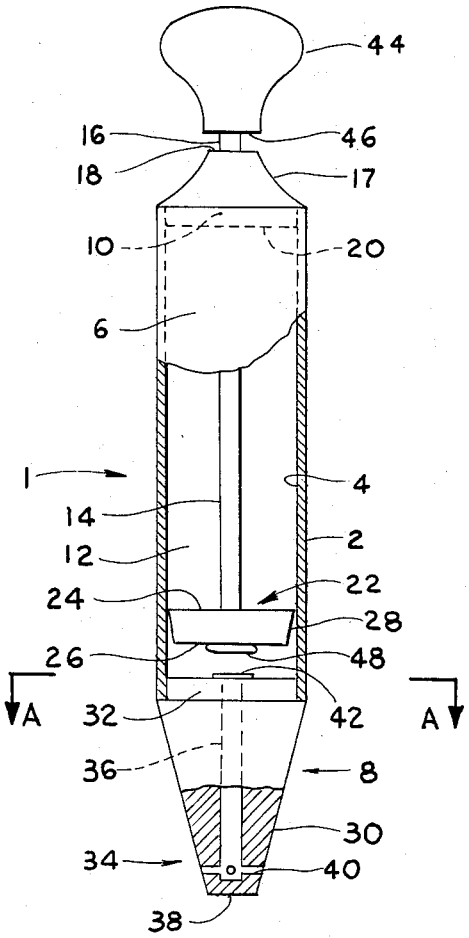
FIG. 2
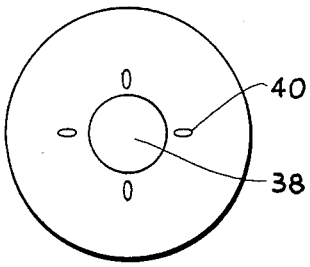
FIG. 3
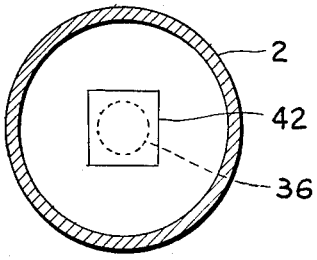
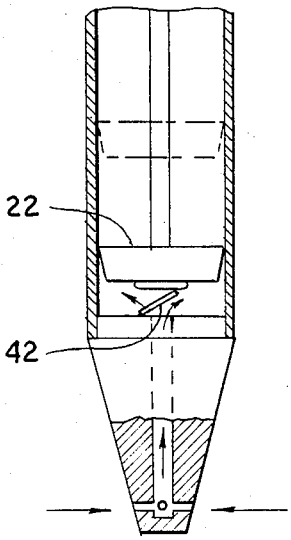
FIG. 4

EVACUATING PUMP

BACKGROUND OF THE INVENTION

Many consumers, disenchanted with rising food prices and declining food quality, have begun supplementing their grocery store purchases with garden grown produce.

Since crops characteristically have a single annual harvesting period, various methods have been devised to preserve the food products to enable continuous consumption throughout the year.

Some chemicals are good preservatives, but the use of chemicals has many undesirable effects. Also, chemicals are not readily available to individual consumers for preserving garden grown produce. "Canning" is a process commonly employed for preserving tomatoes whereby the produce is heated for a prolonged period of time to ensure the destruction of harmful bacteria. One of the drawbacks to canning is that many of the nutrients and much of the taste of the produce is cooked out in the heating step. Also, a totally hermetic environment must be maintained in the canning jars or else harmful bacteria will enter and destroy the food.

"Freezing" is a much more simple method of preserving food. Since extreme heat is not used, the taste and the nutrients of the food are preserved. Produce can be frozen without any cooking or heating, or the produce can be frozen with moderate cooking or heating.

Freezing is practiced domestically and only requires freezer bags to be filled with food, and "twists" used to secure the opening of the bag after filling.

One problem exists in the art of freezing to which no solution has been proffered. When the freezer bags are sealed with the "twists," air trapped within the bag has a tendency to make the frozen food taste stale. Also, humidity in the air tends to crystalize and form ice in the bag after freezing. The ice, when thawed with the food, adds a stale taste to the food.

People who practice the art of domestic freezing have in the past relied on "squeezing" the air out of the bag after filling with food. "Squeezing" is imprecise and cumbersome. No devices are known or commercially available to the practioner to remove unwanted air prior to sealing the freezer bag.

SUMMARY OF THE INVENTION

The present invention fulfills the above described need by providing a simple, inexpensive and easy to operate evacuating pump for completely removing air from the interior of food containers.

The device has a hollow cylindrical body with a nozzle attached to one end and a cap or guide at the opposite end. A plunger is disposed within the cylindrical body except for one end of a reciprocating rod that protrudes through and beyond the cap or guide. A piston is fixedly attached at the opposite end of the reciprocating rod, and, when the plunger is fully extended on an inward stroke, the plunger is disposed near the nozzle. As the plunger is withdrawn on the outward stroke, the piston sealingly engages the inner cylindrical wall of the hollow cylindrical body and creates a vacuum at the nozzle, which, when inserted into a food container, causes the air within the container to be evacuated.

After full extension on the outward stroke, the plunger is pushed inward. To prevent air from being injected through the nozzle as a result of the inward stroke, a check valve is provided at the nozzle. The check valve is preferably a hinged flap that covers the inlet of the nozzle in the presence of pressure, and unseats by pivoting upwardly in the presence of vacuum. Since the inward stroke generates compression, the valve shuts immediately upon initiation of the downstroke. Air being compressed between the piston and the nozzle must be allowed to escape the compression chamber in order to facilitate completion of the inward stroke. Since the air cannot be injected back through the nozzle, an outlet passageway must be provided. In the preferred embodiment, the outlet passageway is provided around the piston. The present device uses a piston that is resilient and has a particular shape that allows engagement in one direction and disengagement in the other direction.

The preferred embodiment of the piston has a cone shape with an outward face opposing the cap and having a diameter approximately the same as that of the interior of the hollow cylindrical body, and an inward face opposing the nozzle and having a diameter smaller than that of the interior of the hollow cylindrical body. A sloping side wall lies between the two faces to complete the cone shape. The outward face contacts the inner cylindrical wall along a peripheral edge of the outward face. On the inward stroke of the plunger, pressure builds up between the piston and the nozzle because of the seated valve and because of the contact between inner cylindrical wall and the piston. The pressure eventually reaches a point where the peripheral edge is forced laterally inwardly and air escapes around the piston, and out through the cap. The escape of air through the cap occurs because the reciprocating rod has a diameter smaller than the central bore provided through the cap.

On the outward stroke of the plunger, the outward base naturally contacts the inner cylindrical surface. However, the vacuum created by the outward stroke encourages an outward expansion of the piston into sealing engagement with the inner cylindrical surface of the hollow cylindrical body.

Preferably, a handle is provided at the outward end of the reciprocating rod so that the device is easily hand operated. Evacuation occurs by pulling the plunger outward (the outward stroke) and the evacuated air is expelled from the device by pushing the plunger inward (the inward stroke).

The preferred nozzle has a cone-shaped body with a base portion insertable into the hollow cylindrical body, a reduced diameter tip portion, and a sloping side wall between the base and the tip. The inlet of the nozzle preferably includes an axial passageway extending from the base portion to a distal point near the tip, and four equidistant lateral ports extending from the distal point to the cone-shaped outer surface of the body. Having the ports on the side of the nozzle prevents ingestion of food particles into the nozzle, and having a cone-shaped body allows the nozzle to be inserted into a freezer bag, for instance, and to be easily removed after evacuation.

The preferred method of evacuating air from a container using the present invention requires that the nozzle be inserted into the opening of, for instance, a freezer bag. The operator uses one hand to hold the bag around the device by gripping the device along the cylindrical body or along the conically-shaped nozzle, with the opening of the bag being hermetically gripped between the operator's hand and the device. Other means may be employed for holding the opening of the bag tightly around the device. One such means may include a rubber band. The operator's other hand is used to move the plunger in and out to evacuate air from within the container. Once air has been removed, the opening of the bag is sealed in the usual fashion and the device is removed. It is also possible to remove the device first, so long as the opening is temporarily closed, as for instance, by pinching between two fingers.

One of the primary objects of the invention is to provide a hand-operated evacuating pump for use in the household for preparing food for freezing.

Another object of the invention is to provide an evacuating pump that is inexpensive, easy to operate, easy to maintain, and uncomplicated.

Another object of the invention is to provide an evacuating pump that creates a vacuum at the nozzle on the outward stroke of the plunger, and pushes air out of the pump on the inward stroke of the plunger.

Another object of the invention is to provide a nozzle that is shaped to slide easily into and out of food containers, and is provided with lateral intake ports to prevent ingestion of food into the nozzle.

Another object of the invention is to provide an apparatus for evacuating air comprising a hollow cylindrical body having outer and inner cylindrical surfaces, a nozzle fixedly attached to one end of the cylindrical body and having a body, a base portion insertable into the cylindrical body and an inlet extending from the base portion through the body, a guide means fixedly attached to the opposite end of the cylindrical body, a plunger having a reciprocating rod, and a resilient piston fixedly attached to one end of the reciprocating rod, the opposite end of the reciprocating rod extending through the guide means, the plunger having an inward stroke generating compression of air between the nozzle and the plunger, and an outward stroke generating vacuum between the nozzle and the piston, and a check valve, attached to the base portion at the nozzle, and seated over the inlet under pressure, and unseated by pivoting upwardly under vacuum, whereby air compressed on the inward stroke escapes peripherally around the resilient piston, and vacuum, evacuated air through the inlet and into the hollow cylindrical body.

These and other and further objects and features of the invention are apparent in the disclosure which includes the above and below specification, claims and drawings.

BRIEF DESCRIPTION OF THE DRAWINGS

FIG. 1 is a cross-sectional view of the device.

FIG. 2 is a bottom view.

FIG. 3 is a cross-sectional view of the device of FIG. 2 taken along line A—A.

FIG. 4 is a cross-sectional view showing operation of the device.

DETAILED DESCRIPTION OF THE DRAWINGS

Referring to FIG. 1, the evacuating pump 1 has a hollow cylindrical body 2 with cylindrical inner surface 4 and cylindrical outer surface 6. A nozzle 8 is fixedly attached at one end of the pump and a cap 10 is fixedly attached at the opposite end. Attachment may be by any conventional means, such as by adhesive bonding or by screw-threading. The preferred attachment means will depend on the materials used to fabricate the cap, nozzle, and body which may be by any combination of plastics or metals.

A plunger 12 is disposed within the body 2 except for an end portion 16 of a reciprocating rod 14 that extends outwardly beyond the cap 10. The cap 10 acts as a guide for the reciprocating rod and can be a solid object with a central bore, or a hollow object with a tapered mid-portion 17 terminating in a reduced diameter annulus 18 that limits the radial movement of the reciprocating rod 14. The base portion 20 of the cap 10 is received within the hollow cylindrical body 2.

A resilient piston 22 is fixedly attached to the opposite end of the reciprocating rod 14, and has an outer face 24 opposing the cap 10, and an inner face 26 opposing the nozzle 8. Preferably, the piston is conically shaped so that the outer face 24 has approximately the same diameter as the inner cylindrical surface 4 while the inner face 26 has a reduced diameter, with a sloped side wall 28 between the outer face 24 and inner face 26. The significance of the conical shape will be described later.

The nozzle 8 has a conically-shaped body 30, a base portion 32 insertable into the hollow cylindrical body 2, and an inlet 34 extending through the nozzle 8.

The inlet has an axial passageway 36 extending from the base to a distal point near the tip 38 of the nozzle, and four lateral ports 40 extending outwardly from the distal point to the outer surface of the conically shaped body 30. The four lateral ports are best illustrated in FIG. 2.

Attached to the base 32 of the nozzle 8 is a check valve or flap 42 which may have any two-dimensional shape as long as it completely covers the inlet 34 of the nozzle. In FIG. 1, the flap 42 covers the axial passageway 36 and can be attached to the base portion 32 along any edge of the flap to provide a hinged connection. In FIG. 3, a rectangular flap 42 is shown covering axial passageway 36.

By attaching a handle 44 to the protruding end 16 of the reciprocating rod 14, the plunger 12 can be easily hand manipulated. FIG. 1 shows the plunger on a fully extended or nearly fully extended inward stroke. One way of limiting the inward stroke is to have the reciprocating rod 14 of such a length that end face 46 of handle 44 abuts annulus 18 when the piston 22 is at or near nozzle 8.

The piston 22 contacts the inner cylindrical surface 4 along a peripheral edge of the outer face 24 in such a way that, as the plunger (and piston) is withdrawn in the outward stroke, a vacuum is created at the lateral ports 40. The vacuum fills the space between the plunger 22 and nozzle 8 with evacuated air. When the nozzle is inserted into a container, the vacuum evacuates air from the container. FIG. 4 shows arrows representing the evacuating of air as the piston moves upwardly away from the nozzle. The vacuum lifts the flap 42 from a seated position to allow evacuated air to enter the hollow cylindrical body. Also, the vacuum encourages the peripheral edge of the outer face 24 into sealing engagement with the inner cylindrical surface 4.

When the plunger is pushed inward on the inward stroke, the flap 42 immediately seats over the axial passageway 36 to prevent air from being injected into the bag. As air pressure due to compression increases, the peripheral edge of the outer face 24 is forced into disengagement with the inner cylindrical surface 4, thereby allowing the evacuated air to escape around the peripheral edge and out of the pump through the cap 10.

Since the piston is resilient, a plate 48 may be provided at the end of the reciprocating rod 14 so that on the outward stroke of the plunger, the plate 48 presses into the inner face 26 to further enhance the sealing engagement between the piston 22 and the inner cylindrical surface 4.

In use, a freezer bag full of food has an opening through which is inserted the nozzle 8 of the evacuating pump 1. The opening is then closed by hand around either the nozzle or the cylindrical body 2; in either case the lateral ports 40 must be inside the bag. Withdrawing the plunger on the outward stroke evacuates air from within the bag and fills the hollow cylindrical body between the plunger and the nozzle with evacuated air until the cylindrical body obtains a mutual pressure. If the bag is fully evacuated, the opening is sealed by conventional means below the tip of the nozzle. If more evacuation is required, the plunger is pushed inward on the inward stroke, creating a positive pressure that closes the flap 42 and eventually causes the release of evacuated air around the plunger 22.

While the invention has been described with reference to specific embodiments, the exact nature and scope of the invention are defined by the following claims.

What I claim is:

1. An apparatus for evacuating air from a food bag comprising, a hollow cylindrical body having outer and inner cylindrical surfaces and first and second end portions, an outlet provided in the first end portion, an inlet provided in the second end portion, compression means having a conically shaped piston, axially movable within the hollow cylindrical body, for creating a vacuum at the inlet, and actuator means, attached to the compression means, for axially displacing the compression means, axial displacement of the compression means away from the inlet providing air-evacuating vacuum at the inlet, valve means attached to the inlet, for closing the inlet in response to pressure and opening the inlet in response to vacuum, wherein said valve means comprises a hinged flap, and a frusto-conically shaped nozzle for projecting into said bag, said nozzle having a base portion fixedly attached to an end of the hollow cylindrical body.

2. The apparatus of claim 1 wherein the inlet comprises an axial passageway extending from the base to a point near the tip of the nozzle, and a plurality of radial passageways extending outwardly from the end of the axial passageway to the surface of the nozzle.

3. An evacuating pump for extracting air from food bags comprising, a hollow cylindrical body, a cap attached to one end of the cylindrical body, and having a central bore therethrough, a frusto-conically shaped nozzle for projecting into one of said bags, said nozzle being, attached to the opposite end of the cylindrical body, a plunger slideably disposed within the cylindrical body, the plunger having a reciprocating rod with an outward end extending outwardly through the central bore, and a resilient piston fixedly attached to an inward end of the reciprocating rod, the piston being conically shaped, valve means, connected to the nozzle, for shutting the nozzle in response to compression generated on an inward stroke of the plunger, and for opening the nozzle in response to vacuum generated on the outward stroke of the plunger, wherein the valve means comprises a hinged flap.

4. The apparatus of claim 3 wherein the piston is conically shaped with a first end facing the cap and having the same diameter as the inner cylindrical wall of the hollow cylindrical body, and a second end facing the nozzle and having a reduced diameter, the first end sealingly engaging the inner cylindrical wall on the outward stroke of the plunger, and disengaging the inner cylindrical wall on the inward stroke.

5. The apparatus of claim 4, further comprising a handle fixedly attached to the outward end of the reciprocating rod.

6. The apparatus of claim 5, wherein the handle has an end face abutting an end face of the cap limiting the length of the inward stroke of the plunger.

7. The apparatus of claim 5 wherein the nozzle comprises a conically shaped body with a base portion insertable into the hollow cylindrical body, an axial passageway extending from the base portion to a distal point near the tip, and a plurality of radial ports extending outwardly from the distal point to the outer surface of the conically shaped body.

8. The apparatus of claim 3 wherein the valve means comprises a check valve flap, hinged along one side to an inner end of the nozzle, and seating over the nozzle under internal compression and unseating by pivoting upwardly under vacuum.

9. The apparatus of claim 7 wherein the valve means comprises a hinged flap attached to the base portion of the nozzle and covering the axial passageway under pressure, and uncovering the axial passageway under vacuum.

10. The apparatus of claim 9 comprising four symetrically spaced radial ports.

11. An apparatus for evacuating air comprising, a hollow cylindrical body having outer and inner cylindrical surfaces, a nozzle fixedly attached to one end of the cylindrical body and having a frusto-conically shaped body for projecting into a bag, a base portion insertable into the cylindrical body, and an inlet extending from the base portion through the nozzle body, a guide means fixedly attached to the opposite end of the cylindrical body, a plunger having a reciprocating rod, and a resilient piston fixedly attached to one end of the reciprocating rod, the opposite end of the reciprocating rod extending through the guide means, the plunger having an inward stroke generating compression of air between the nozzle and the plunger, and an outward stroke generating vacuum between the nozzle and the piston, and a check valve, attached to the base portion of the nozzle, and seated over the inlet under pressure, and unseated by pivoting upwardly under vacuum, whereby air compressed on the inward stroke escapes peripherally around the resilient piston, and vacuum evacuates air through the inlet and into the hollow cylindrical body.

12. The apparatus of claim 11 wherein the guide means comprises a cap having a base portion insertable into the hollow cylindrical body, a tapered portion extending upwardly from the base portion of the cap, and a central axial passageway for slideably receiving the reciprocating rod.

13. The apparatus of claim 11 wherein the inlet of the nozzle comprises an axial passageway extending from the base portion to a distal point near the tip of the nozzle, and a plurality of radial ports extending outwardly from the distal point.

14. The apparatus of claim 11 further comprising a handle fixedly attached to the outward end of the reciprocating rod.

15. The apparatus of claim 11 wherein the piston is conically shaped and has an inward face, opposite the nozzle, having a diameter smaller than the diameter of the interior of the hollow cylindrical body, and an outward face, opposite the guide means, having a diameter approximately equal to the diameter of the interior of the hollow cylindrical body and having a peripheral edge in contact with the inner cylindrical surface of the hollow cylindrical body and a sloping side wall between the two faces, whereby compression between the piston and the nozzle forces disengagement of the peripheral edge of the outward face from the inner surface of the hollow cylindrical body to allow the escape of compressed air around the peripheral edge, and vacuum forces the peripheral edge into sealing engagement with the inner surface of the hollow cylindrical body.

* * * * *